US008780155B2

(12) United States Patent
Tonishi

(10) Patent No.: US 8,780,155 B2
(45) Date of Patent: Jul. 15, 2014

(54) TAPE CASSETTE AND TAPE PRINTING APPARATUS

(71) Applicant: Brother Kogyo Kabushiki Kaisha, Nagoya (JP)

(72) Inventor: Hisako Tonishi, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/626,189

(22) Filed: Sep. 25, 2012

(65) Prior Publication Data

US 2013/0021423 A1 Jan. 24, 2013

Related U.S. Application Data

(63) Continuation-in-part of application No. PCT/JP2011/071115, filed on Sep. 15, 2011.

(30) Foreign Application Priority Data

Sep. 16, 2010 (JP) ..... 2010-208234
Sep. 16, 2010 (JP) ..... 2010-208235

(51) Int. Cl.
*B41J 2/325* (2006.01)

(52) U.S. Cl.
USPC ..... 347/215; 347/214; 503/227; 428/32.51

(58) Field of Classification Search
USPC ..... 347/211–222
See application file for complete search history.

(56) References Cited

U.S. PATENT DOCUMENTS

| | | | | |
|---|---|---|---|---|
| 5,240,781 | A | 8/1993 | Obata et al. | |
| 5,398,051 | A * | 3/1995 | Fukui et al. | 347/213 |
| 5,564,845 | A * | 10/1996 | Yamaguchi et al. | 400/582 |
| 5,663,115 | A | 9/1997 | Naito et al. | |
| 7,138,359 | B2 * | 11/2006 | Washizuka | 503/227 |
| 7,340,831 | B2 * | 3/2008 | Yamaguchi et al. | 29/890.1 |
| 7,799,736 | B2 * | 9/2010 | Irita et al. | 503/227 |
| 7,942,593 | B2 * | 5/2011 | Yamaguchi et al. | 400/76 |
| 2007/0213220 | A1 * | 9/2007 | Irita et al. | 503/227 |

(Continued)

FOREIGN PATENT DOCUMENTS

| | | |
|---|---|---|
| CN | 1118887 | 3/1996 |
| JP | 2-106555 A | 4/1990 |

(Continued)

OTHER PUBLICATIONS

International Preliminary Search Report issued in PCT/JP2011/071115 on Apr. 18, 2013.

(Continued)

*Primary Examiner* — Matthew Luu
*Assistant Examiner* — Lily Kemathe
(74) *Attorney, Agent, or Firm* — McCarter & English, LLP

(57) ABSTRACT

The tape cassette used in a tape printing apparatus incorporates an ink ribbon including a thermal printing layer including a coloring layer containing wax and pigment coated on a base film and an adhesive layer coated on the coloring layer, and a congealing point of the thermal printing layer is controlled to be 89 degrees Celsius or higher and difference between a glass transition point of the thermal printing layer and a melting point of the thermal printing layer is controlled to be 23 degrees Celsius or smaller.

8 Claims, 8 Drawing Sheets

| | GLASS TRANSITION POINT | CONGEALING POINT | MELTING POINT | DIFFERENCE | BLURRING EVALUATION | REVERSE TRANSFER EVALUATION |
|---|---|---|---|---|---|---|
| | °C | °C | °C | MELTING POINT —GLASS TRANSITION POINT | | |
| EXEMPLARY EMBODIMENT 1 | 74.3 | 89.4 | 97.0 | 22.8 | ○ | ○ |
| COMPARATIVE EXAMPLE 1 | 65.3 | 80.7 | 89.7 | 24.4 | × | × |
| COMPARATIVE EXAMPLE 2 | 64.6 | 79.5 | 88.5 | 23.8 | × | × |
| COMPARATIVE EXAMPLE 3 | 68.9 | 90.2 | 96.3 | 27.4 | × | ○ |

(56) References Cited

U.S. PATENT DOCUMENTS

| | | | | |
|---|---|---|---|---|
| 2008/0279605 | A1* | 11/2008 | Yamaguchi et al. | 400/613 |
| 2010/0239348 | A1* | 9/2010 | Yamaguchi | 400/621 |
| 2013/0021423 | A1* | 1/2013 | Tonishi | 347/214 |

FOREIGN PATENT DOCUMENTS

| | | | |
|---|---|---|---|
| JP | 4-62188 | A | 2/1992 |
| JP | 5-139052 | A | 6/1993 |
| JP | 7-172010 | A | 7/1995 |
| JP | 3025311 | B2 | 3/2000 |
| JP | 2009155874 | | 7/2009 |

OTHER PUBLICATIONS

International Search Report of PCT/JP2011/071115 dated Oct. 25, 2011.

Chinese Office Action issued in Application No. 201180026268.7 on Dec. 4, 2013.

* cited by examiner

FIG. 4

| | COLORING LAYER (wt%) | | | | ADHESIVE LAYER (wt%) | | | |
|---|---|---|---|---|---|---|---|---|
| | PIGMENT | WAX | RESIN | ADDITIVES | WAX | RESIN | ADDITIVES | TOTAL |
| EXEMPLARY EMBODIMENTS 1 to 4 | 17 | 36 | 20 | 10 | 8 | 7 | 2 | 100 |
| COMPARATIVE EXAMPLES 1, 4, 7, 10 | 17 | 40 | 16 | 10 | 8 | 7 | 2 | 100 |
| COMPARATIVE EXAMPLES 2, 5, 8, 11 | 17 | 34 | 22 | 10 | 8 | 7 | 2 | 100 |
| COMPARATIVE EXAMPLES 3, 6, 9, 12 | 17 | 33 | 23 | 10 | 8 | 7 | 2 | 100 |

FIG. 5

| | GLASS TRANSITION POINT | CONGEALING POINT | MELTING POINT | DIFFERENCE | BLURRING EVALUATION | REVERSE TRANSFER EVALUATION |
|---|---|---|---|---|---|---|
| | °C | °C | °C | MELTING POINT −GLASS TRANSITION POINT | | |
| EXEMPLARY EMBODIMENT 1 | 74.3 | 89.4 | 97.0 | 22.8 | ○ | ○ |
| COMPARATIVE EXAMPLE 1 | 65.3 | 80.7 | 89.7 | 24.4 | × | × |
| COMPARATIVE EXAMPLE 2 | 64.6 | 79.5 | 88.5 | 23.8 | × | × |
| COMPARATIVE EXAMPLE 3 | 68.9 | 90.2 | 96.3 | 27.4 | × | ○ |

FIG. 6

| | GLASS TRANSITION POINT | CONGEALING POINT | MELTING ENERGY | MELTING ENERGY /GLASS TRANSITION POINT | BLURRING EVALUATION | REVERSE TRANSFER EVALUATION |
|---|---|---|---|---|---|---|
| | °C | °C | J/g | | | |
| EXEMPLARY EMBODIMENT 2 | 74.3 | 89.4 | 33.0 | 0.44 | ○ | ○ |
| COMPARATIVE EXAMPLE 4 | 65.3 | 80.7 | 37.3 | 0.57 | × | × |
| COMPARATIVE EXAMPLE 5 | 64.6 | 79.5 | 30.1 | 0.47 | × | × |
| COMPARATIVE EXAMPLE 6 | 68.9 | 90.2 | 48.4 | 0.70 | × | ○ |

FIG. 7

| | GLASS TRANSITION POINT | CONGEALING POINT | MELTING POINT | DIFFERENCE | | BLURRING EVALUATION | REVERSE TRANSFER EVALUATION |
|---|---|---|---|---|---|---|---|
| | °C | °C | °C | MELTING POINT —CONGEALING POINT | MELTING POINT —GLASS TRANSITION POINT | | |
| EXEMPLARY EMBODIMENT 3 | 74.3 | 89.4 | 97.0 | 7.6 | 22.8 | ○ | ○ |
| COMPARATIVE EXAMPLE 7 | 65.3 | 80.7 | 89.7 | 8.9 | 24.4 | × | × |
| COMPARATIVE EXAMPLE 8 | 64.6 | 79.5 | 88.5 | 8.9 | 23.8 | × | × |
| COMPARATIVE EXAMPLE 9 | 68.9 | 90.2 | 96.3 | 6.1 | 27.4 | × | ○ |

FIG. 8

| | GLASS TRANSITION POINT | CONGEALING POINT | MELTING POINT | MELTING ENERGY | DIFFERENCE | MELTING ENERGY /GLASS TRANSITION POINT | BLURRING EVALUATION | REVERSE TRANSFER EVALUATION |
|---|---|---|---|---|---|---|---|---|
| | °C | °C | °C | J/g | MELTING POINT −CONGEALING POINT | | | |
| EXEMPLARY EMBODIMENT 4 | 74.3 | 89.4 | 97.0 | 33.0 | 7.6 | 0.44 | ○ | ○ |
| COMPARATIVE EXAMPLE 10 | 65.3 | 80.7 | 89.7 | 37.3 | 8.9 | 0.57 | × | × |
| COMPARATIVE EXAMPLE 11 | 64.6 | 79.5 | 88.5 | 30.1 | 8.9 | 0.47 | × | × |
| COMPARATIVE EXAMPLE 12 | 68.9 | 90.2 | 96.3 | 48.4 | 6.1 | 0.70 | × | ○ |

TAPE CASSETTE AND TAPE PRINTING APPARATUS

CROSS-REFERENCE TO RELATED APPLICATION

The present application is a continuation application of PCT International Patent Application No. PCT/JP2011/071115 filed on Sep. 15, 2011 which designated the United States, and claims priority to Japanese Patent Application Nos. JP 2010-208234 and JP2010-208235 filed on Sep. 16, 2010. The contents of each of the prior filed applications are incorporated herein by reference.

TECHNICAL FIELD

The disclosure relates to a tape cassette incorporating a print tape and an ink ribbon, and a tape printing apparatus configured to make a printed tape on which a print image such as a character is formed, utilizing the tape cassette. The disclosure specifically relates to a tape cassette incorporating an ink ribbon capable of preventing a print image from being faintly printed when printed on a print tape or an ink void from occurring in a print image on the print tape, so as to allow a clear print image on the print tape to be printed, and a tape printing apparatus using the tape cassette. The ink void appears in the print image of the print tape due to occurrence of a phenomenon called reverse transfer, in which, after ink is transferred from the ink ribbon to the print tape, the transferred ink on the print tape is transferred back to the ink ribbon.

BACKGROUND

Conventionally, there has been proposed an ink ribbon for a thermal transfer printer having a thermal head that allows formation of print images on various printing media in cases from low-speed printing where printing energy is high to high-speed printing where printing energy is low, as disclosed, for instance, in Japanese Patent No. 3025311.

In a conventional ink ribbon as in the above, a thermoplastic adhesive layer with film forming properties is formed on a surface of a coloring layer having a waxy material as the major component of a vehicle thereof, so as to form a thermal transfer layer, and a material with supercooling properties is used for the adhesive layer, so that it is made possible to lengthen a duration maintaining a state in which the adhesive layer melts and softens to exhibit high adhesive force, and to form a print image on various printing media.

However, if the duration maintaining the state in which the adhesive layer melts and softens to exhibit the high adhesive force is lengthened as in the above-mentioned ink ribbon, even though the print image can be formed on the various printing media, the possibility of reverse transfer of the print image onto the ink ribbon side becomes high due to the longer duration of melting and softening of the adhesive layer.

Thus, if a print image is reverse-transferred onto the ink ribbon side, an ink void occurs in the print image on a printing medium, thus inhibiting a clear print image.

SUMMARY

The disclosure has been made to solve the above conventional problem and has an object to provide a tape cassette incorporating an ink ribbon capable of preventing a faintly printed print image printed on a print tape and an ink void in a print image on the print tape from occurring, so as to allow a clear print image to be printed on the print tape, and a tape printing apparatus using the tape cassette.

To achieve the object, there is provided the tape cassette configured to be used in a tape printing apparatus that performs printing on a print tape using a thermal head, wherein the tape cassette incorporates a print tape spool around which the print tape is wound and a ribbon spool around which an ink ribbon is wound, and wherein a print image such as a character is to be formed on the print tape through the ink ribbon using the thermal head, wherein the ink ribbon comprises: a base film; and a thermal printing layer formed on the base film and comprising a coloring layer containing wax and pigment, and an adhesive layer coated on the coloring layer, and wherein a congealing point of the thermal printing layer is 89 degrees Celsius or higher, and difference between a melting point of the thermal printing layer and a glass transition point of the thermal printing layer is 23 degrees Celsius or smaller.

In the ink ribbon inside the tape cassette, the congealing point of the thermal printing layer including the coloring layer and the adhesive layer is set to be 89 degrees Celsius or higher, so that the thermal printing layer solidifies even at a high temperature of 89 degrees Celsius or higher. By the solidification of the thermal printing layer, the duration in which the thermal printing layer softens and melts can be shortened in a region where printing energy by the thermal head is high so that the print image can be securely prevented from being reverse-transferred onto the ink ribbon side.

At the same time, through setting the difference between the melting point of the thermal printing layer and the glass transition point of the thermal printing layer in the ink ribbon to be 23 degrees Celsius or smaller, the difference between the temperature at which the thermal printing layer softens at the glass transition point and the melting point at which the thermal printing layer melts becomes smaller. Through making this temperature difference smaller, the thermal printing layer can soften and melt with excellent sensitivity in a region where the printing energy of the thermal head is low, so that the print image can be securely prevented from being printed in a faintly printed state on the print tape.

BRIEF DESCRIPTION OF THE DRAWINGS

FIG. 4 is a table of components forming thermal printing layers in ink ribbons directed to exemplary embodiments 1 through 4 and comparative examples 1 through 12, respectively.

FIG. 5 is a table showing physical property values and evaluation results of the ink ribbons directed to the exemplary embodiment 1 and the comparative examples 1 through 3.

FIG. 6 is a table showing physical property values and evaluation results of the ink ribbons directed to an exemplary embodiment 2 and comparative examples 4 through 6.

FIG. 7 is a table showing physical property values and evaluation results of the ink ribbons directed to an exemplary embodiment 3 and comparative examples 7 through 9.

FIG. 8 is a table showing physical property values and evaluation results of the ink ribbons directed to an exemplary embodiment 4 and comparative examples 10 through 12.

DETAILED DESCRIPTION

Hereinafter, a detailed description of exemplary embodiments of a tape cassette and a tape printing apparatus according to the disclosure will now be given referring to the accompanying drawings. The drawings referred to are used for illustration of the technical features that the disclosure can employ and merely for exemplary purposes. First, the schematic configuration of the tape printing apparatus directed to the present embodiment will be discussed referring to FIG. 1 and FIG. 2.

Figure 1:
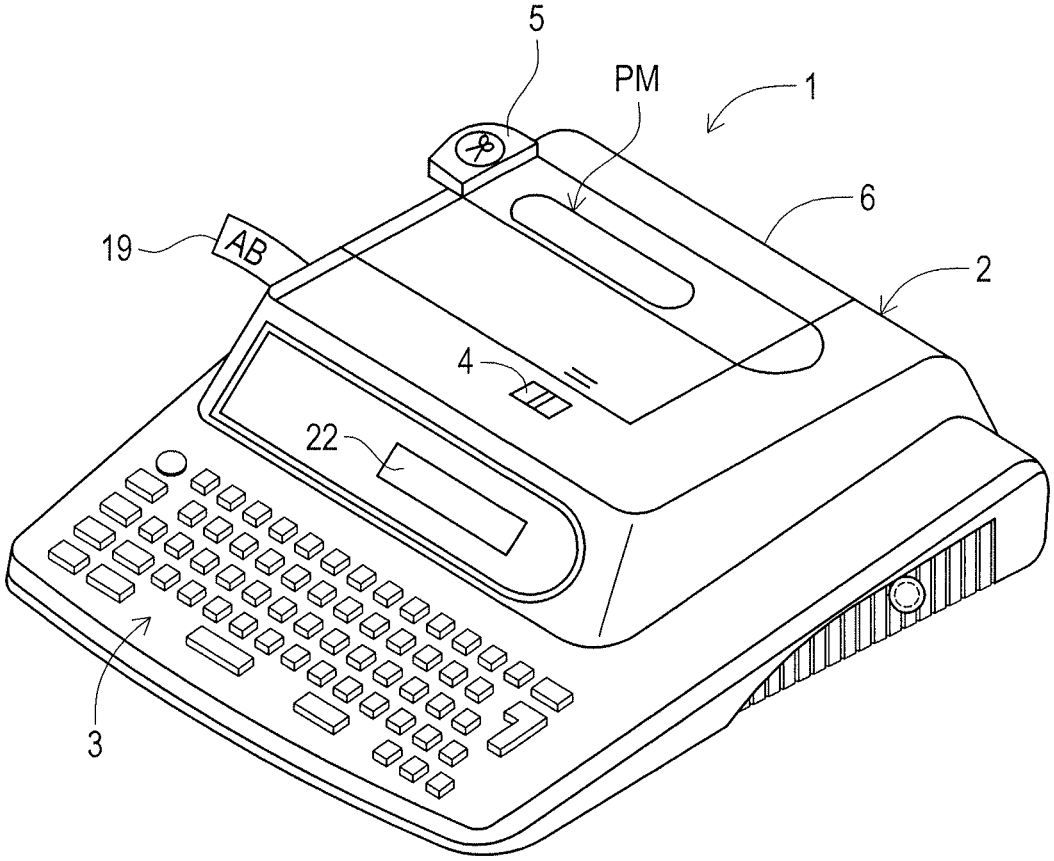
FIG. 1 is a perspective view of a tape printing apparatus directed to the present embodiment.

In FIG. 1, a tape printing apparatus 1 includes a main frame 2, a keyboard 3 arranged in a front portion of the main frame 2, a printing mechanism PM installed at a back portion inside the main frame 2, a liquid crystal display (LCD) 2 capable of displaying letters or symbols and provided immediately behind the keyboard 3, a cover frame 6 covering an upper surface of the main frame 2, and the like. Furthermore, in the upper surface of the main frame 2, there is provided a release button 4 for opening the cover frame 6 when attaching or detaching a tape cassette CS designed to be mounted on the printing mechanism PM. Further, at the side edge of the cover frame 6 (on the left side end in FIG. 1), a cut-off operation button 5 for manually cutting off a printed tape 19 is provided.

On the keyboard 3 are arranged various kinds of keys such as character keys for inputting alphabets, numerals, symbols and the like, a space key, a return key, an end-of-line key, a cursor move key for moving a cursor rightward or leftward, and a size setting key for arbitrarily setting a size of characters to be printed.

Next, the printing mechanism PM will be discussed referring to FIG. 2. The rectangular tape cassette CS is detachably mounted onto the printing mechanism PM. The tape cassette CS rotatably incorporates a tape spool 8 around which a transparent print tape 7 is wound, a ribbon spool 10 around which an ink ribbon 9 having a base film with ink to melt by heat application, a take-up spool 11 for taking up the ink ribbon 9, a feeding spool 13 around which a double-sided adhesive tape 12 having the same width as the print tape 7 is wound in with a release sheet thereof facing outward, and a joining roller 14 for bonding the print tape 7 and the double-sided adhesive tape 12. Adhesive layers are formed on a base tape of the double-sided adhesive tape 12 on both sides thereof, and a release sheet is applied on one of the adhesive layers on both sides of the base tape.

A thermal head 15 is raised at a position where the print tape 7 and the ink ribbon 9 make contact. A supporting body 18 is pivotally supported in the main frame 2. At the supporting body 18, there are rotatably supported a platen roller 16 for pressing the print tape 7 and the ink ribbon 9 onto the thermal head 15, and a conveyor roller 17 for pressing the print tape 7 and the double-sided adhesive tape 12 onto the joining roller 14 so as to produce the printed tape 19. On the thermal head 15, a heater element group (not shown) composed of 128 pieces of heater elements is arranged in a row in an up-down direction (a direction vertical to the tape surface).

Accordingly, if a tape conveying motor 47 (refer to FIG. 3) is driven in a predetermined rotation direction, the joining roller 14 and the take-up spool 11 are driven synchronizingly with each other in the predetermined rotation direction and the heater element group is energized so that predetermined heater elements generate heat to heat up the ink ribbon 9. With this heat, the ink applied on the ink ribbon 9 melts and is thermally-transferred onto the print tape 7. As a result, characters or barcodes are printed on the print tape 7 with a plurality of dot rows. Then the print tape 7 is conveyed in a tape conveying direction A as a printed tape 19 while being bonded with the double-sided adhesive tape 12, and as illustrated in FIG. 1 and FIG. 2, conveyed outside the main frame 2 (to the left side on FIG. 1). Incidentally, detailed description on configuration of the printing mechanism PM is omitted here as the configuration is described in Japanese Laid-open Patent Application Publication No. 2-106555 and well-known.

Figure 2:
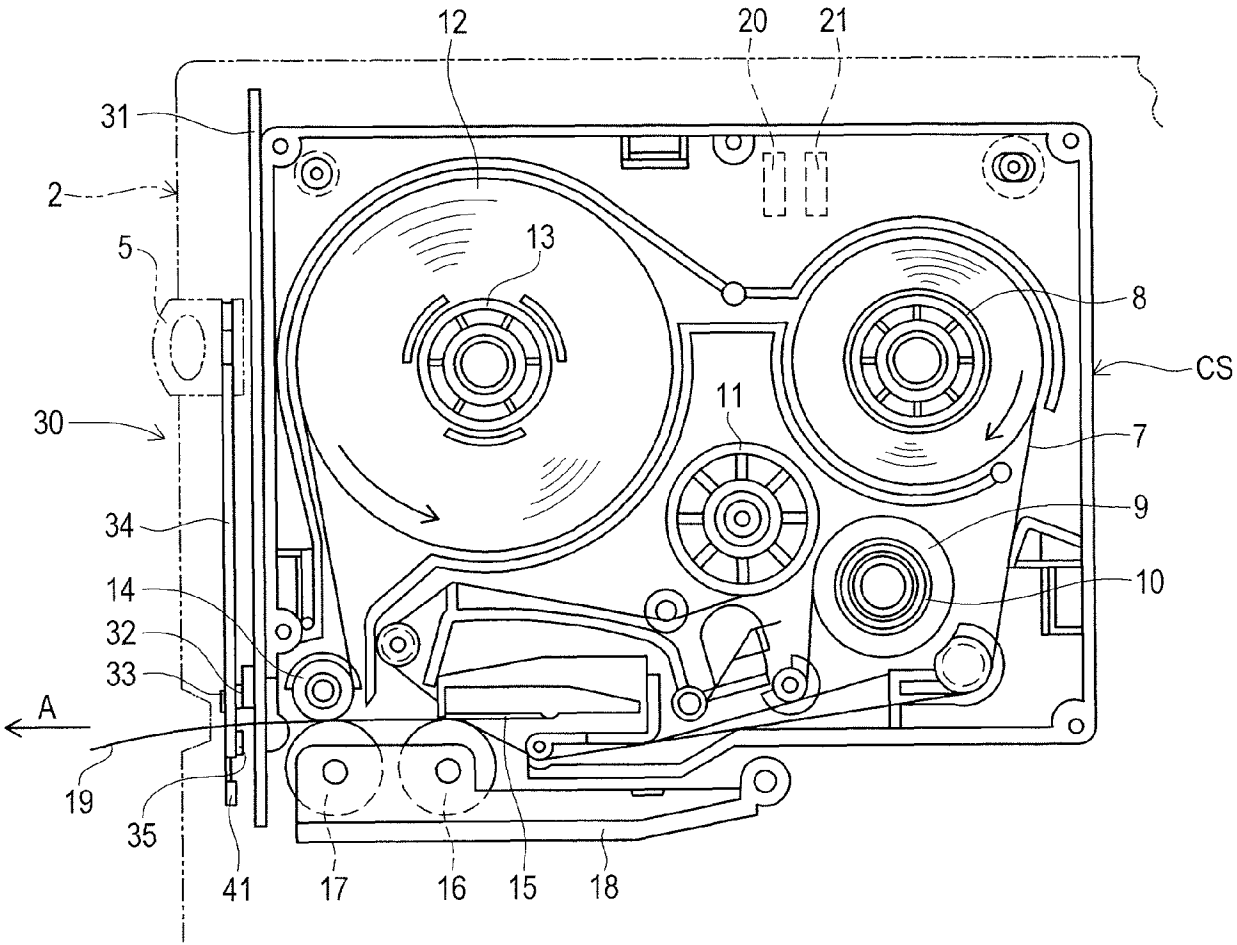
FIG. 2 is a partially enlarged sectional view inside a main frame showing a tape cassette placed and stored inside the main frame of the tape printing apparatus directed to the present embodiment.

Next, a manual cut-off device 30 provided for cutting off the printed tape 19 is discussed referring to FIG. 2. The main frame 2 contains an auxiliary frame 31 having a plate-like shape inside thereof, and the auxiliary frame 31 is provided with a fixed blade 32 fixed facing upward. The auxiliary frame 31 further provided with a pivot shaft 33 fixedly therein, and an operation lever 34 extending in a front-back direction. At a portion near a front end portion thereof, the operation lever 34 is pivotally supported by the pivot shaft 33. Further, in the operation lever 34, at a portion more frontward than the portion corresponding to the pivot shaft 33, a movable blade 35 is attached so as to face the fixed blade 32.

Further, a rear end portion of the operation lever 34 is positioned below the cut-off operation button 5, and the operation lever 34 in a normal state is elastically urged by a spring member (not shown) in a direction to move the movable blade 35 away from the fixed blade 32. Furthermore, on the front end portion of the operation lever 34 is attached a cut-off switch 41 that detects the pivotal movement of the operation lever 34 for cutting off, through the depression of the cut-off operation button 5.

After the characters and the like are printed, the printed tape 19 passes between the fixed blade 32 and the movable blade 35, and extends to the outside of the main frame 2, therefore if the cut-off operation button 5 is pressed down, the movable blade 35 is moved toward the fixed blade 32 by the operation lever 34, and the printed tape 19 is cut off by the both blades 32, 35.

Figure 3:
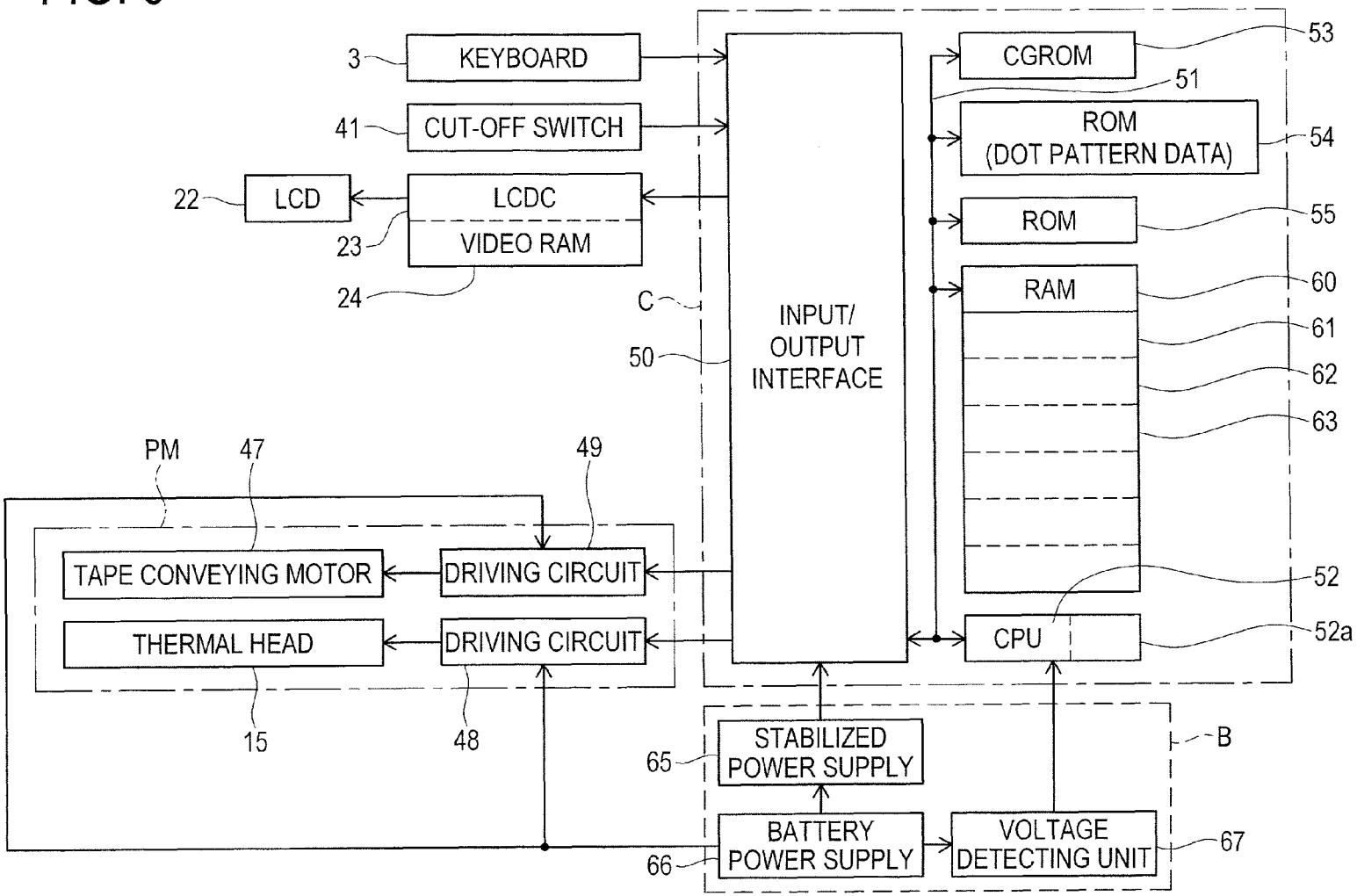
FIG. 3 is a block diagram showing a control structure of the tape printing apparatus directed to the present embodiment.

Next, the configuration regarding the control of the tape printing apparatus 1 of the present embodiment is discussed referring to FIG. 3. In FIG. 3, a control unit C is composed of a CPU 52 that controls various devices in the tape printing apparatus 1, an input/output interface 50 coupled to the CPU 52 via a data bus 51, CGROM 53, ROM 54, 55, and RAM 60. In addition, a timer 52a is installed inside the CPU 52.

The input/output interface 50 is coupled to the keyboard 3, the cut-off switch 41, a liquid crystal display controller (hereinafter referred to as LCDC) 23 including video RAM 24 for displaying display data in the LCD 22, a driving circuit 48 for driving the thermal head 15 and a driving circuit 49 for driving the tape conveying motor 47, respectively.

Dot pattern data for display regarding each of various characters are respectively associated with code data and stored at the CGROM 53.

The ROM 54 (operating as dot pattern data memory) stores print dot pattern data for printing characters such as alphabetical letters and symbols regarding each of the various characters. Furthermore, the ROM 54 also stores graphic pattern data for printing a graphic image including gradation expression.

The ROM 55 stores a display drive control program and a print drive control program and the like. The display drive control program is a program for associating the LCDC 23 with character code data of letters and numerals inputted from the keyboard 3 to control the LCDC 23. The print drive control program is a program for reading out data from a print buffer 62 to drive the thermal head 15 and the tape conveying motor 47.

The RAM 60 includes text memory 61, the print buffer 62, a counter 63 and the like, and the text memory 61 stores document data inputted from the keyboard 3. The print buffer 62 stores print dot patterns for a plurality of letters and symbols as print data. The counter 63 stores count values N counted in association with each heater element in gradation control processing.

Further, a power supply unit B supplies electricity to the control unit C and the printing mechanism PM as mentioned above, and includes a battery power supply 66 for supplying power to the entire apparatus, a voltage detecting unit 67 for detecting the voltage of the battery power supply 66, and a stabilized power supply 65 for converting the voltage of the battery power supply 66 into a constant voltage and outputting the converted voltage.

The battery power supply 66 is coupled to each of the driving circuits 48, 49, so as to directly supply the power from the battery power supply 66 to the driving circuits 48, 49. Meanwhile, the stabilized power supply 65 is coupled to the control unit C including the LCD 22 and the power from the battery power supply 66 converted to the constant voltage is fed to the stabilized power supply 65. Incidentally, as a power supply for the disclosure, the battery power supply 66 is used in the present embodiment. However, instead of the battery power supply 66, there may be used DC power supply composed of an AC adapter that receives commercial power supply, rectifies and steps down the alternate current therefrom so as to output direct current.

The voltage detecting unit 67 is coupled to the CPU 52 of the control unit C, detects the voltage of the battery power supply 66 during printing by a predetermined cycle, and outputs the detection result to the CPU 52.

Next, the ink ribbon 9 installed inside the tape cassette CS is discussed referring to the drawings.

The ink ribbon 9 inside the tape cassette CS to be used in the tape printing apparatus 1 directed to the present embodiment includes a base film formed of polyethylene terephthalate and the like. The base film has a coloring layer applied and formed thereon. The coloring layer is obtained through kneading pigment such as carbon black, wax such as paraffin wax, resin such as ethylene vinyl acetate copolymer, and various additives. Further, the coloring layer has an adhesive layer applied and formed thereon. The adhesive layer is obtained through kneading wax such as paraffin wax, resin such as ethylene vinyl acetate copolymer, and various additives.

Here, the ink ribbon 9 is used when forming a print image such as a character on the print tape 7 in the tape printing apparatus 1. There, based on the drive of the tape conveying motor 47, the joining roller 14 and the take-up spool 11 convey the print tape 7 and the ink ribbon 9. The speed for conveying the print tape 7 and the ink ribbon 9 is set to be within 10 mm/sec through 80 mm/sec.

The reason to set the lower limit of the conveying speed as 10 mm/sec is discussed below. In a case where the tape printing apparatus 1 is downsized to allow a battery drive, the conveying speed achievable by the battery drive is approximately 10 mm/sec. Further, the conveying speed slower than 10 mm/sec seems too slow as a printing apparatus, and also the conveying speed slower than 10 mm/sec may induce dumping in a case a stepping motor is used as the tape conveying motor 47.

Further, the reason to set the upper limit of the conveying speed as 80 mm/sec is discussed below. The tape printing apparatus 1 directed to the present embodiment is on the premise of an ordinary household use. However, the printing with high printing energy is required for achieving the high-speed printing faster than 80 mm/sec, and high-voltage supply is required in order to supply such high printing energy. Taking the household use of the tape printing apparatus 1 into consideration, use of the high-voltage supply may raise safety concerns. Further, the resistance value of the thermal head 15 may be lowered for the purpose of achieving the high printing energy supply, but such decrease of the resistance value means a larger current flow in the substrate, implying increase in cost of the substrate. Furthermore, the substrate may need to become larger, which causes increase in size of the tape printing apparatus 1 in its entirety, preventing the achievement of downsizing with a view to the household use. Still further, with a condition of the power supply and the tape printing apparatus 1 itself, if the conveying speed is set faster than 80 mm/sec, the motor torque becomes insufficient, hindering the stable tape travel.

In addition to the condition of the conveying speed, the printing energy by the thermal head 15 is set within 20 $mJ/mm^2$ through 45 $mJ/mm^2$.

Here, the reason to set the lower limit of the printing energy of the thermal head 15 as 20 $mJ/mm^2$ is discussed below. If the tape printing apparatus 1 is downsized to allow the battery drive, the printing energy to be achieved by the battery drive is approximately 20 $mJ/mm^2$. Further, in an ink ribbon 9 printable below the printing energy of 20 $mJ/mm^2$, the adhesive layer is required to soften and melt at quite a low temperature. Accordingly, in a state wound around the ribbon spool 10, the ink layer of the ink ribbon 9 makes close contact with the back of the base film, which is likely to cause the ink removal and a blocking phenomenon which increases the pulling-out force of the ink ribbon 9.

Further, the reason to set the upper limit of the printing energy by the thermal head 15 as 45 $mJ/mm^2$ is discussed below. It is a general tendency to design the tape printing apparatus 1 to be an energy-saving type, and to achieve the energy saving, the upper limit of the printing energy is set as 45 $mJ/mm^2$. Further, if continuous printing is carried out in the printing energy exceeding 45 $mJ/mm^2$, the temperature of the thermal head 15 becomes too high, causing a safety concern as the tape printing apparatus 1 for ordinary household use.

Next, exemplary embodiments 1 through 4 with regard to the ink ribbon 9 will be discussed referring to FIG. 4 through FIG. 8.

Exemplary Embodiment 1

As shown in FIG. 4, in the exemplary embodiment 1, there were prepared 17 wt % carbon black as a pigment, 36 wt % paraffin wax as a wax, 20 wt % ethylene vinyl acetate copolymer as a resin component, and 10 wt % additives such as dispersing agent, which were then mixed, stirred and evenly kneaded so that a coloring-layer mixture was obtained. The coloring-layer mixture was applied by a coater on a base film made of polyethylene terephthalate to form a coloring layer on the base film. The coloring layer was 2 μm thick.

Following that, there were prepared 8 wt % paraffin wax as a wax, 7 wt % polycaprolactone as a resin component and 2 wt % additives such as heat resistance improving agent, which were then mixed, stirred and evenly kneaded so that an adhesive-layer mixture was obtained. The adhesive-layer mixture was applied by the coater on the coloring layer to form an adhesive layer. Thus, the ink ribbon directed to the exemplary embodiment 1 was obtained.

In the ink ribbon 9 of the exemplary embodiment 1 obtained as in the above, the thermal printing layer composed of the coloring layer and the adhesive layer was measured by a differential scanning calorimeter (DSC: Q200 from TA Instruments) with respect to a glass transition point, a congealing point and a melting point thereof. The measurement result is shown in FIG. 5. As shown in FIG. 5, the glass transition point was 74.3 degrees Celsius, the congealing point was 89.4 degrees Celsius and the melting point was 97.0 degrees Celsius. The difference between the melting point and the glass transition point was 22.8 degrees Celsius.

The tape cassette CS incorporating the ink ribbon 9 according to the exemplary embodiment 1 was mounted onto the tape printing apparatus 1. Then, at the conveying speed of the tape conveying motor 47, the joining roller 14 and the take-up spool 11 being 10 mm/sec through 80 mm/sec, and with printing energy 20 mJ/mm$^2$ through 45 mJ/mm$^2$, the thermal head 15 was driven to heat up so as to form a print image on the print tape 7, and the print image was evaluated. There was no blurring in the print image formed on the print tape 7, and further, no reverse transfer of the print image to the ink ribbon 9 occurred. The print image formed on the print tape 7 was of good quality.

Incidentally, the blurring was evaluated as follows. The ink ribbon was installed in an HG cassette manufactured by Brother Industries, Ltd., and the HG cassette was set in a tape printing apparatus (PT9700PC) manufactured by Brother Industries, Ltd., and printing was performed under the environment at a temperature of 5 degrees Celsius in a high-speed printing mode. The print contents of characters "一二" (Japanese character) in MSP Mincho font of a size 10-point were inputted and prepared by P-touch Editor provided by Brother Industries, Ltd. and printed. As to the evaluation result, "○" represents "no blurring was recognized in the characters," and "×" represents "blurring was recognized in the characters."

Further, the reverse transfer was evaluated as follows. The ink ribbon was installed in an HG cassette manufactured by Brother Industries, Ltd., and the HG cassette was set in the tape printing apparatus (PT9700PC) manufactured by Brother Industries, Ltd., and printing was performed under an environment at a temperature of 35 degrees Celsius and a humidity of 80%, continuously for 8 m. The print content of a solid pattern was inputted and prepared by the P-touch Editor provided by Brother Industries, Ltd. and printed. As to the evaluation result, "○" represents "no reverse transfer was recognized in the 8 m print," and "×" represents "reverse transfer was recognized in the 8 m print."

Thus, through setting the difference between the melting point of the thermal printing layer and the glass transition point of the thermal printing layer to be 23 degrees Celsius or smaller, the difference between the temperature where the thermal printing layer softens at the glass transition point and the melting point where the thermal printing layer melts becomes small. Accordingly, it can be considered that, specifically when only low printing energy is supplied from the thermal head 15 at high-speed printing, the thermal printing layer can soften and melt with high sensitivity, preventing the print image from blurring in printing.

Through setting the congealing point of the thermal printing layer to be 89 degrees Celsius or higher, the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side can be prevented.

Comparative Example 1

The ink ribbon 9 of the comparative example 1 was obtained in the same method for the ink ribbon of the exemplary embodiment 1, except the change of wax content to be 40 wt %, and resin to be 16 wt % in the coloring layer.

In the ink ribbon 9 of the comparative example 1 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 1. The measurement result is shown in FIG. 5. As shown in FIG. 5, the glass transition point was 65.3 degrees Celsius, the congealing point was 80.7 degrees Celsius and the melting point was 89.7 degrees Celsius. The difference between the melting point and the glass transition point was 24.4 degrees Celsius.

The tape cassette CS incorporating the ink ribbon 9 according to the comparative example 1 was mounted onto the tape printing apparatus 1. Then, the thermal head 15 was driven to heat up under the same condition regarding the conveying speed and the printing energy as that in the exemplary embodiment 1, so as to form a print image on the print tape 7, and the print image was evaluated. There was blurring in the print image formed on the print tape 7, and further, reverse transfer of the print image to the ink ribbon 9 occurred.

Thus, in a case where the difference between the melting point of the thermal printing layer and the glass transition point of the thermal printing layer is larger than 23 degrees Celsius, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Further, the congealing point of the thermal printing layer is 80.7 degrees Celsius, which is lower than 89 degrees Celsius; therefore the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Comparative Example 2

The ink ribbon 9 of the comparative example 2 was obtained in the same method for the ink ribbon of the exemplary embodiment 1, except the change of wax content to be 34 wt %, and resin to be 22 wt % in the coloring layer.

In the ink ribbon 9 of the comparative example 2 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 1. The measurement result is shown in FIG. 5. As shown in FIG. 5, the glass transition point was 64.6 degrees Celsius, the congealing point was 79.5 degrees Celsius and the melting point was 88.9 degrees Celsius. The difference between the melting point and the glass transition point was 23.8 degrees Celsius.

The tape cassette CS incorporating the ink ribbon 9 according to the comparative example 2 was mounted onto the tape printing apparatus 1. Then, the thermal head 15 was driven to heat up under the same condition regarding the conveying speed and the printing energy as that in the exemplary embodiment 1, so as to form a print image on the print tape 7, and the print image was evaluated. There was blurring in the print image formed on the print tape 7, and further, reverse transfer of the print image to the ink ribbon 9 occurred.

Thus, in a case where the difference between the melting point of the thermal printing layer and the glass transition point of the thermal printing layer is larger than 23 degrees Celsius, similar to the case of the comparative example 1, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Further, the congealing point of the thermal printing layer is 79.5 degrees Celsius, which is lower than 89 degrees Celsius; therefore similar to the case of the comparative example 1, the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Comparative Example 3

The ink ribbon 9 of the comparative example 3 was obtained in the same method for the ink ribbon of the exemplary embodiment 1, except the change of wax content to be 33 wt %, and resin to be 23 wt % in the coloring layer.

In the ink ribbon 9 of the comparative example 3 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 1. The measurement result is shown in FIG. 5. As shown in FIG. 5, the glass transition point was 68.9 degrees Celsius, the congealing point was 90.2 degrees Celsius and the melting point was 96.3 degrees Celsius. The difference between the melting point and the glass transition point was 27.4 degrees Celsius.

The tape cassette CS incorporating the ink ribbon 9 according to the comparative example 3 was mounted onto the tape printing apparatus 1. Then, the thermal head 15 was driven to heat up under the same condition regarding the conveying speed and the printing energy as that in the exemplary embodiment 1, so as to form a print image on the print tape 7, and the print image was evaluated. Although there was blurring in the print image formed on the print tape 7, reverse transfer of the print image to the ink ribbon 9 did not occur.

Thus, in a case where the difference between the melting point of the thermal printing layer and the glass transition point of the thermal printing layer is larger than 23 degrees Celsius, similar to the case of the comparative example 1, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Meanwhile, the congealing point of the thermal printing layer is 90.2 degrees Celsius, which is higher than 89 degrees Celsius; therefore the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side is prevented.

Exemplary Embodiment 2

As shown in FIG. 4, in the exemplary embodiment 2, similar to the case of the exemplary embodiment 1, there were prepared 17 wt % carbon black as a pigment, 36 wt % paraffin wax as a wax, 20 wt % ethylene vinyl acetate copolymer as a resin component, and 10 wt % additives such as dispersing agent, which were then mixed, stirred and evenly kneaded so that a coloring-layer mixture was obtained. The coloring-layer mixture was applied by a coater on a base film made of polyethylene terephthalate to form a coloring layer on the base film. The coloring layer was 2 μm thick.

Following that, there were prepared 8 wt % paraffin wax as a wax, 7 wt % polycaprolactone as a resin component and 2 wt % additives such as heat resistance improving agent, which were then mixed, stirred and evenly kneaded so that an adhesive-layer mixture was obtained. The adhesive-layer mixture was applied by the coater on the coloring layer to form an adhesive layer. Thus, the ink ribbon directed to the exemplary embodiment 2 was obtained.

In the ink ribbon 9 of the exemplary embodiment 2 obtained as in the above, the thermal printing layer composed of the coloring layer and the adhesive layer was measured by the differential scanning calorimeter (DSC: Q200 from TA Instruments) with respect to a glass transition point and a congealing point thereof. The measurement result is shown in FIG. 6. As shown in FIG. 6, the glass transition point was 74.3 degrees Celsius and the congealing point was 89.4 degrees Celsius. Further, the melting energy was 33.0 J/g, and a value obtained through dividing the melting energy of the thermal printing layer by the temperature of the glass transition point of the thermal printing layer was 0.44.

The tape cassette CS incorporating the ink ribbon 9 according to the exemplary embodiment 2 was mounted onto the tape printing apparatus 1. Then, at the conveying speed of the tape feed motor 47, the junction roller 14 and the take-up spool 11 being 10 mm/sec through 80 mm/sec, and with printing energy 20 mJ/mm$^2$ through 45 mJ/mm$^2$, the thermal head 15 was driven to heat up so as to form a print image on the print tape 7, and the print image was evaluated. There was no blurring in the print image formed on the print tape 7, and further, no reverse transfer of the print image to the print tape 7 occurred. The print image formed on the print tape 7 was of good quality.

Thus, through setting the value obtained through dividing melting energy of the thermal printing layer by the glass transition point of the thermal printing layer to be 0.44 or smaller, the difference between the temperature where the thermal printing layer softens at the glass transition point and the melting point where the thermal printing layer melts becomes small. Accordingly, it can be considered that, in a region where the printing energy of the thermal head is low, the thermal printing layer can soften and melt with high sensitivity, preventing the print image from blurring in printing.

Here, the sensitivity of the ink ribbon is improved as the glass transition point becomes lower or the melting energy decreases. Accordingly, the value obtained by dividing the melting energy by the glass transition point can be a value indicating the critical value for the sensitivity of the glass transition point and the amount of the melting energy.

Through setting the congealing point of the thermal printing layer to be 89 degrees Celsius or higher, the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side can be prevented.

Comparative Example 4

Similar to the case of the comparative example 1, the ink ribbon 9 of the comparative example 4 was obtained in the same method for the ink ribbon of the exemplary embodiment 2, except the change of wax content to be 40 wt %, and resin to be 16 wt % in the coloring layer.

In the ink ribbon 9 of the comparative example 4 obtained as in the above, the thermal printing layer composed of the coloring layer and the adhesive layer was measured by the differential scanning calorimeter (DSC) with respect to a glass transition point and a congealing point thereof, in the same manner as in the exemplary embodiment 2. The measurement result is shown in FIG. 6. As shown in FIG. 6, the glass transition point was 65.3 degrees Celsius and the congealing point was 80.7 degrees Celsius. Further, the melting energy was 37.3 J/g, and a value obtained through dividing the melting energy of the thermal printing layer by the temperature of the glass transition point of the thermal printing layer was 0.57.

The tape cassette CS incorporating the ink ribbon 9 according to the comparative example 4 was mounted onto the tape printing apparatus 1. Then, the thermal head 15 was driven to heat up under the same condition regarding the conveying speed and the printing energy as that in the exemplary embodiment 2, so as to form a print image on the print tape 7, and the print image was evaluated. There was blurring in the print image formed on the print tape 7, and further, reverse transfer of the print image to the ink ribbon 9 occurred.

Thus, in a case where the value obtained through dividing the melting energy of the thermal printing layer by the glass transition point of the thermal printing layer exceeds 0.44, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Further, the congealing point of the thermal printing layer is 80.7 degrees Celsius, which is lower than 89 degrees Celsius; therefore the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Comparative Example 5

Similar to the case of the comparative example 2, the ink ribbon 9 of the comparative example 5 was obtained in the same method for the ink ribbon of the exemplary embodiment 2, except the change of wax content to be 34 wt %, and resin to be 22 wt % in the coloring layer.

In the ink ribbon 9 of the comparative example 5 obtained as in the above, the thermal printing layer composed of the coloring layer and the adhesive layer was measured by the differential scanning calorimeter (DSC) with respect to a glass transition point and a congealing point thereof, in the same manner as in the exemplary embodiment 2. The measurement result is shown in FIG. 6. As shown in FIG. 6, the glass transition point was 64.6 degrees Celsius and the congealing point was 79.5 degrees Celsius. Further, the melting energy was 30.1 J/g, and a value obtained through dividing the melting energy of the thermal printing layer by the temperature of the glass transition point of the thermal printing layer was 0.47.

The tape cassette CS incorporating the ink ribbon 9 according to the comparative example 5 was mounted onto the tape printing apparatus 1. Then, the thermal head 15 was driven to heat up under the same condition regarding the conveying speed and the printing energy as that in the exemplary embodiment 2, so as to form a print image on the print tape 7, and the print image was evaluated. There was blurring in the print image formed on the print tape 7, and further, reverse transfer of the print image to the ink ribbon 9 occurred.

Thus, in a case where the value obtained through dividing the melting energy of the thermal printing layer by the glass transition point of the thermal printing layer exceeds 0.44, similar to the case of the comparative example 4, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Further, the congealing point of the thermal printing layer is 79.5 degrees Celsius, which is lower than 89 degrees Celsius; therefore similar to the case of the comparative example 4, the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Comparative Example 6

Similar to the case of the comparative example 3, the ink ribbon 9 of the comparative example 6 was obtained in the same method for the ink ribbon of the exemplary embodiment 2, except the change of wax content to be 33 wt %, and resin to be 23 wt % in the coloring layer.

In the ink ribbon 9 of the comparative example 6 obtained as in the above, the thermal printing layer composed of the coloring layer and the adhesive layer was measured by the differential scanning calorimeter (DSC) with respect to a glass transition point and a congealing point thereof, in the same manner as in the exemplary embodiment 2. The measurement result is shown in FIG. 6. As shown in FIG. 6, the glass transition point was 68.9 degrees Celsius and the congealing point was 90.2 degrees Celsius. Further, the melting energy was 48.4 J/g, and a value obtained through dividing the melting energy of the thermal printing layer by the temperature of the glass transition point of the thermal printing layer was 0.70.

The tape cassette CS incorporating the ink ribbon 9 according to the comparative example 6 was mounted onto the tape printing apparatus 1. Then, the thermal head 15 was driven to heat up under the same condition regarding the conveying speed and the printing energy as that in the exemplary embodiment 2, so as to form a print image on the print tape 7, and the print image was evaluated. Although there was blurring in the print image formed on the print tape 7, reverse transfer of the print image to the ink ribbon 9 did not occur.

Thus, in a case where the value obtained through dividing the melting energy of the thermal printing layer by the glass transition point of the thermal printing layer exceeds 0.44, similar to the case of the comparative example 4, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Meanwhile, the congealing point of the thermal printing layer is 90.2 degrees Celsius, which is higher than 89 degrees Celsius; therefore the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side is prevented.

Exemplary Embodiment 3

As shown in FIG. 4, in the exemplary embodiment 3, similar to the case of the exemplary embodiments 1, 2, there were prepared 17 wt % carbon black as a pigment, 36 wt % paraffin wax as a wax, 20 wt % ethylene vinyl acetate copolymer as a resin component, and 10 wt % additives such as dispersing agent, which were then mixed, stirred and evenly kneaded so that a coloring-layer mixture was obtained. The coloring-layer mixture was applied by a coater on a base film made of polyethylene terephthalate to form a coloring layer on the base film. The coloring layer was 2 μm thick.

Following that, there were prepared 8 wt % paraffin wax as a wax, 7 wt % polycaprolactone as a resin component and 2 wt % additives such as heat resistance improving agent, which were then mixed, stirred and evenly kneaded so that an adhesive-layer mixture was obtained. The adhesive-layer mixture was applied by the coater on the coloring layer to form an adhesive layer. Thus, the ink ribbon directed to the exemplary embodiment 3 was obtained.

In the ink ribbon 9 of the exemplary embodiment 3 obtained as in the above, the thermal printing layer composed of the coloring layer and the adhesive layer was measured by the differential scanning calorimeter (DSC: Q200 from TA Instruments) with respect to a glass transition point, a congealing point and a melting point thereof. The measurement result is shown in FIG. 5. As shown in FIG. 5, the glass transition point was 74.3 degrees Celsius, the congealing point was 89.4 degrees Celsius and the melting point was 97.0 degrees Celsius. The difference between the melting point and the congealing point was 7.6 degrees Celsius, and the difference between the melting point and the glass transition point was 22.8 degrees Celsius.

The tape cassette CS incorporating the ink ribbon 9 according to the exemplary embodiment 3 was mounted onto the tape printing apparatus 1. Then, at the conveying speed of the tape conveying motor 47, the joining roller 14 and the take-up spool 11 being 10 mm/sec through 80 mm/sec, and with printing energy 20 mJ/mm$^2$ through 45 mJ/mm$^2$, the thermal head 15 was driven to heat up so as to form a print image on the print tape 7, and the print image was evaluated. There was no blurring in the print image formed on the print tape 7, and further, no reverse transfer of the print image to the print tape 7 occurred. The print image formed on the print tape 7 was of good quality.

Through setting the congealing point of the thermal printing layer to be 89 degrees Celsius or higher, the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side can be prevented.

Further, it can be considered that, through setting the difference between the melting point and the congealing point of the thermal printing layer to be 7.6 degrees Celsius or smaller, the duration until the thermal printing layer in the ink ribbon 9 solidifies after melting can be shortened, so that the print image can be prevented from being reverse-transferred onto the ink ribbon 9 side.

As has been discussed in the above, through setting the congealing point of the thermal printing layer to be 89 degrees Celsius or higher and the difference between the melting point and the congealing point of the thermal printing layer to be 7.6 degrees Celsius or smaller, reverse transfer of the print image onto the ink ribbon 9 side can be reliably prevented.

Furthermore, similar to the case of the exemplary embodiment 1, in the thermal printing layer of the ink ribbon 9 according to the exemplary embodiment 3, through setting the difference between the melting point of the thermal printing layer and the glass transition point of the thermal printing layer to be 23 degrees Celsius or smaller, the difference between the temperature where the thermal printing layer softens at the glass transition point and the melting point where the thermal printing layer melts becomes small. Accordingly, it can be considered that, specifically when only low printing energy is supplied from the thermal head 15 at high-speed printing, the thermal printing layer can soften and melt with high sensitivity, preventing the print image from blurring in printing.

Comparative Example 7

Similar to the case of the comparative example 1, the ink ribbon 9 of the comparative example 7 was obtained in the same method for the ink ribbon of the exemplary embodiment 3, except the change of wax content to be 40 wt %, and resin to be 16 wt % in the coloring layer.

In the ink ribbon 9 of the comparative example 7 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 3. The measurement result is shown in FIG. 7. As shown in FIG. 7, the glass transition point was 65.3 degrees Celsius, the congealing point was 80.7 degrees Celsius and the melting point was 89.7 degrees Celsius. The difference between the melting point and the congealing point was 8.9 degrees Celsius, and the difference between the melting point and the glass transition point was 24.4 degrees Celsius.

The tape cassette CS incorporating the ink ribbon 9 according to the comparative example 7 was mounted onto the tape printing apparatus 1. Then, the thermal head 15 was driven to heat up under the same condition regarding the conveying speed and the printing energy as that in the exemplary embodiment 3, so as to form a print image on the print tape 7, and the print image was evaluated. There was blurring in the print image formed on the print tape 7, and further, reverse transfer of the print image to the ink ribbon 9 occurred.

Further, the congealing point of the thermal printing layer is 80.7 degrees Celsius, which is lower than 89 degrees Celsius; therefore the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Further, it can be considered that, as the difference between the melting point and the congealing point of the thermal printing layer is 8.9 degrees Celsius, which exceeds 7.6 degrees Celsius, the duration until the thermal printing layer in the ink ribbon 9 solidifies after melting becomes longer, so that the print image is reverse-transferred onto the ink ribbon 9 side.

Furthermore, similar to the case of the comparative example 1, in the thermal printing layer of the ink ribbon 9 according to the comparative example 7, the difference between the melting point of the thermal printing layer and the glass transition point of the thermal printing layer is larger than 23 degrees Celsius, and in such a case, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Comparative Example 8

Similar to the case of the comparative example 2, the ink ribbon 9 of the comparative example 8 was obtained in the same method for the ink ribbon of the exemplary embodiment 3, except the change of wax content to be 34 wt %, and resin to be 22 wt % in the coloring layer.

In the ink ribbon 9 of the comparative example 8 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 3. The measurement result is shown in FIG. 7. As shown in FIG. 7, the glass transition point was 64.6 degrees Celsius, the congealing point was 79.5 degrees Celsius and the melting point was 88.5 degrees Celsius. The difference between the melting point and the congealing point was 8.9 degrees Celsius, and the difference between the melting point and the glass transition point was 23.8 degrees Celsius.

The tape cassette CS incorporating the ink ribbon 9 according to the comparative example 8 was mounted onto the tape printing apparatus 1. Then, the thermal head 15 was driven to heat up under the same condition regarding the conveying speed and the printing energy as that in the exemplary embodiment 3, so as to form a print image on the print tape 7, and the print image was evaluated. There was blurring in the print image formed on the print tape 7, and further, reverse transfer of the print image to the ink ribbon 9 occurred.

Further, the congealing point of the thermal printing layer is 79.5 degrees Celsius, which is lower than 89 degrees Celsius; therefore similar to the case of the comparative example 2, the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Further, it can be considered that, as the difference between the melting point and the congealing point of the thermal printing layer is 8.9 degrees Celsius, which exceeds 7.6 degrees Celsius; the duration until the thermal printing layer in the ink ribbon 9 solidifies after melting becomes longer, so that the print image is reverse-transferred onto the ink ribbon 9 side.

Furthermore, similar to the case of the comparative example 2, in the thermal printing layer of the ink ribbon 9 according to the comparative example 8, the difference between the melting point of the thermal printing layer and the glass transition point of the thermal printing layer is larger than 23 degrees Celsius, and in such a case, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Comparative Example 9

Similar to the case of the comparative example 3, the ink ribbon 9 of the comparative example 9 was obtained in the same method for the ink ribbon of the exemplary embodiment 3, except the change of wax content to be 33 wt %, and resin to be 23 wt % in the coloring layer.

In the ink ribbon 9 of the comparative example 9 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 3. The measurement result is shown in FIG. 7. As shown in FIG. 7, the glass transition point was 68.9 degrees Celsius, the congealing point was 90.2 degrees Celsius and the melting point was 96.3 degrees Celsius. The difference between the melting point and the congealing point was 6.1 degrees Celsius, and the difference between the melting point and the glass transition point was 27.4 degrees Celsius.

The tape cassette CS incorporating the ink ribbon 9 according to the comparative example 9 was mounted onto the tape printing apparatus 1. Then, the thermal head 15 was driven to heat up under the same condition regarding the conveying speed and the printing energy as that in the exemplary embodiment 3, so as to form a print image on the print tape 7, and the print image was evaluated. Although there was blurring in the print image formed on the print tape 7, reverse transfer of the print image to the ink ribbon 9 did not occur.

Meanwhile, the congealing point of the thermal printing layer is 90.2 degrees Celsius, which is higher than 89 degrees Celsius; therefore the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side is prevented.

Further, it can be considered that, the difference between the melting point and the congealing point of the thermal printing layer is 6.1 degrees Celsius, and through setting the difference between the melting point and the congealing point of the thermal printing layer to be 7.6 degrees Celsius or smaller, the duration until the thermal printing layer in the ink ribbon 9 solidifies after melting can be shortened, so that the print image can be prevented from being reverse-transferred onto the ink ribbon 9 side.

Meanwhile, similar to the case of the comparative example 3, in the thermal printing layer of the ink ribbon 9 according to the comparative example 9, the difference between the melting point of the thermal printing layer and the glass transition point of the thermal printing layer is larger than 23 degrees Celsius, and in such a case, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Exemplary Embodiment 4

As shown in FIG. 4, in the exemplary embodiment 4, similar to the case of the exemplary embodiments 1 through 3, there were prepared 17 wt % carbon black as a pigment, 36 wt % paraffin wax as a wax, 20 wt % ethylene vinyl acetate copolymer as a resin component, and 10 wt % additives such as dispersing agent, which were then mixed, stirred and evenly kneaded so that a coloring-layer mixture was obtained. The coloring-layer mixture was applied by a coater on a base film made of polyethylene terephthalate to form a coloring layer on the base film. The coloring layer was 2 μm thick.

Following that, there were prepared 8 wt % paraffin wax as a wax, 7 wt % polycaprolactone as a resin component and 2 wt % additives such as heat resistance improving agent, which were then mixed, stirred and evenly kneaded so that an adhesive-layer mixture was obtained. The adhesive-layer mixture was applied by the coater on the coloring layer to form an adhesive layer. Thus, the ink ribbon directed to the exemplary embodiment 4 was obtained.

In the ink ribbon 9 of the exemplary embodiment 4 obtained as in the above, the thermal printing layer composed of the coloring layer and the adhesive layer was measured by the differential scanning calorimeter (DSC: Q200 from TA Instruments) with respect to a glass transition point, a congealing point and a melting point thereof. The measurement result is shown in FIG. 8. As shown in FIG. 8, the glass transition point was 74.3 degrees Celsius, the congealing point was 89.4 degrees Celsius and the melting point was 97.0 degrees Celsius, and the melting energy was 33.0 J/g. The difference between the melting point and the congealing point was 7.6 degrees Celsius, and the value obtained through dividing the melting energy of the thermal printing layer by the temperature of the glass transition point of the thermal printing layer was 0.44.

The tape cassette CS incorporating the ink ribbon 9 according to the exemplary embodiment 4 was mounted onto the tape printing apparatus 1. Then, at the conveying speed of the tape conveying motor 47, the joining roller 14 and the take-up spool 11 was 10 mm/sec through 80 mm/sec, and with printing energy 20 mJ/mm$^2$ through 45 mJ/mm$^2$, the thermal head 15 was driven to heat up so as to form a print image on the print tape 7, and the print image was evaluated. There was no blurring in the print image formed on the print tape 7, and further, no reverse transfer of the print image to the print tape 7 occurred. The print image formed on the print tape 7 was of good quality.

Through setting the congealing point of the thermal printing layer to be 89 degrees Celsius or higher, the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side can be prevented.

Further, it can be considered that, through setting the difference between the melting point and the congealing point of the thermal printing layer to be 7.6 degrees Celsius or smaller, the duration until the thermal printing layer in the ink ribbon 9 solidifies after melting can be shortened, so that the print image can be prevented from being reverse-transferred onto the ink ribbon 9 side.

As has been discussed in the above, through setting the congealing point of the thermal printing layer to be 89 degrees Celsius or higher and the difference between the melting point and the congealing point of the thermal printing layer to be 7.6 degrees Celsius or smaller, reverse transfer of the print image onto the ink ribbon 9 side can be reliably prevented.

Furthermore, similar to the case of the exemplary embodiment 2, in the thermal printing layer of the ink ribbon 9 according to the exemplary embodiment 4, through setting the value obtained through dividing melting energy of the thermal printing layer by the glass transition point of the thermal printing layer to be 0.44 or smaller, the difference between the temperature where the thermal printing layer softens at the glass transition point and the melting point where the thermal printing layer melts becomes small. Accordingly, it can be considered that, in a region where the printing energy of the thermal head is low, the thermal printing layer can soften and melt with high sensitivity, preventing the print image from blurring in printing.

Here, the sensitivity of the ink ribbon is improved as the glass transition point becomes lower or the melting energy decreases. Accordingly, the value obtained by dividing the melting energy by the glass transition point can be a value indicating the critical value for the sensitivity of the glass transition point and the amount of the melting energy.

Comparative Example 10

Similar to the case of the comparative example 1, the ink ribbon 9 of the comparative example 10 was obtained in the same method for the ink ribbon of the exemplary embodiment 4, except the change of wax content to be 40 wt %, and resin to be 16 wt % in the coloring layer.

In the ink ribbon 9 of the comparative example 10 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 4. The measurement result is shown in FIG. 8. As shown in FIG. 8, the glass transition point was 65.3 degrees Celsius, the congealing point was 80.7 degrees Celsius, the melting point was 89.7 degrees Celsius, and the melting energy was 37.3 J/g. The difference between the melting point and the congealing point was 8.9 degrees Celsius, and the value obtained through dividing the melting energy of the thermal printing layer by the glass transition point of the thermal printing layer was 0.57.

The tape cassette CS incorporating the ink ribbon 9 according to the comparative example 10 was mounted onto the tape printing apparatus 1. Then, the thermal head 15 was driven to heat up under the same condition regarding the conveying speed and the printing energy as that in the exemplary embodiment 4, so as to form a print image on the print tape 7, and the print image was evaluated. There was blurring in the print image formed on the print tape 7, and further, reverse transfer of the print image to the ink ribbon 9 occurred.

Further, the congealing point of the thermal printing layer is 80.7 degrees Celsius, which is lower than 89 degrees Celsius; therefore the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Further, it can be considered that, as the difference between the melting point and the congealing point of the thermal printing layer is 8.9 degrees Celsius, which exceeds 7.6 degrees Celsius; the duration until the thermal printing layer in the ink ribbon 9 solidifies after melting becomes longer, so that the print image is reverse-transferred onto the ink ribbon 9 side.

Furthermore, similar to the case of the comparative example 4, as in the thermal printing layer of the ink ribbon 9 according to the comparative example 10, in a case where the value obtained through dividing the melting energy of the thermal printing layer by the glass transition point of the thermal printing layer exceeds 0.44, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Comparative Example 11

Similar to the case of the comparative example 2, the ink ribbon 9 of the comparative example 11 was obtained in the same method for the ink ribbon of the exemplary embodiment 4, except the change of wax content to be 34 wt %, and resin to be 22 wt % in the coloring layer.

In the ink ribbon 9 of the comparative example 11 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 4. The measurement result is shown in FIG. 8. As shown in FIG. 8, the glass transition point was 64.6 degrees Celsius, the congealing point was 79.5 degrees Celsius, the melting point was 88.5 degrees Celsius, and the melting energy was 30.1 J/g. The difference between the melting point and the congealing point was 8.9 degrees Celsius, and the value obtained through dividing the melting energy of the thermal printing layer by the glass transition point of the thermal printing layer was 0.47.

The tape cassette CS incorporating the ink ribbon 9 according to the comparative example 11 was mounted onto the tape printing apparatus 1. Then, the thermal head 15 was driven to heat up under the same condition regarding the conveying speed and the printing energy as that in the exemplary embodiment 4, so as to form a print image on the print tape 7, and the print image was evaluated. There was blurring in the print image formed on the print tape 7, and further, reverse transfer of the print image to the ink ribbon 9 occurred.

Further, the congealing point of the thermal printing layer is 79.5 degrees Celsius, which is lower than 89 degrees Celsius; therefore similar to the case of the comparative example 2, the thermal printing layer does not become solid until a comparatively low temperature. Accordingly, it can be considered that, specifically in a case where high printing energy is applied from the thermal head 15 in low-speed printing, due to the longer duration in which the thermal printing layer softens and melts, the print image is reverse-transferred onto the ink ribbon 9 side.

Further, it can be considered that, as the difference between the melting point and the congealing point of the thermal printing layer is 8.9 degrees Celsius, which exceeds 7.6 degrees Celsius; the duration until the thermal printing layer in the ink ribbon 9 solidifies after melting becomes longer, so that the print image is reverse-transferred onto the ink ribbon 9 side.

Furthermore, similar to the case of the comparative example 4, as in the thermal printing layer of the ink ribbon 9 according to the comparative example 11, in a case where the value obtained through dividing the melting energy of the thermal printing layer by the glass transition point of the thermal printing layer exceeds 0.44, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

Comparative Example 12

Similar to the case of the comparative example 3, the ink ribbon 9 of the comparative example 12 was obtained in the same method for the ink ribbon of the exemplary embodiment 4, except the change of wax content to be 33 wt %, and resin to be 23 wt % in the coloring layer.

In the ink ribbon 9 of the comparative example 12 obtained as in the above, the thermal printing layer composed of the coloring layer and the adhesive layer was measured by the differential scanning calorimeter (DSC) with respect to a glass transition point, a congealing point and a melting point thereof, in the same manner as in the exemplary embodiment 4. The measurement result is shown in FIG. 8. As shown in FIG. 8, the glass transition point was 68.9 degrees Celsius, the congealing point was 90.2 degrees Celsius, the melting point was 96.3 degrees Celsius, and the melting energy was 48.4 J/g. The difference between the melting point and the congealing point was 6.1 degrees Celsius, and the value obtained through dividing the melting energy of the thermal printing layer by the glass transition point of the thermal printing layer was 0.70.

The tape cassette CS incorporating the ink ribbon 9 according to the comparative example 12 was mounted onto the tape printing apparatus 1. Then, the thermal head 15 was driven to heat up under the same condition regarding the conveying speed and the printing energy as that in the exemplary embodiment 4, so as to form a print image on the print tape 7, and the print image was evaluated. Although there was blurring in the print image formed on the print tape 7, reverse transfer of the print image to the ink ribbon 9 did not occur.

Meanwhile, the congealing point of the thermal printing layer is 90.2 degrees Celsius, which is higher than 89 degrees Celsius; therefore the thermal printing layer solidifies even at a high temperature of 89 degrees Celsius or higher. Accordingly, it can be considered that, specifically even in a case where high printing energy is applied from the thermal head 15 in low-speed printing, the duration in which the thermal printing layer softens and melts is made shorter and reverse transfer of the print image onto the ink ribbon 9 side is prevented.

Further, it can be considered that, the difference between the melting point and the congealing point of the thermal printing layer is 6.1 degrees Celsius, and through setting the difference between the melting point and the congealing point of the thermal printing layer to be 7.6 degrees Celsius or smaller, the duration until the thermal printing layer in the ink ribbon 9 solidifies after melting can be shortened, so that the print image can be prevented from being reverse-transferred onto the ink ribbon 9 side.

Furthermore, similar to the case of the comparative example 4, as in the thermal printing layer of the ink ribbon 9 according to the comparative example 12, in a case where the value obtained through dividing the melting energy of the thermal printing layer by the glass transition point of the thermal printing layer exceeds 0.44, the difference between the temperature where the thermal printing layer softens at the glass transition point and the melting point where the thermal printing layer melts becomes large. Accordingly, it can be considered that, specifically when only low printing energy is supplied from the thermal head 15 at high-speed printing, the thermal printing layer cannot soften and melt with high sensitivity, resulting in the print image printed blurring.

It is to be noted that the disclosure is not restricted to aspects directed to the present embodiment and that various changes and modification may be made without departing from the gist of the invention.

For instance, in the tape printing apparatus 1 directed to the present embodiment, the thermal head 15 is configured to be fixedly arranged to convey the print tape 7 and the ink ribbon 9 in a manner being put together. However, the disclosure is not limited to this embodiment, but can be achieved also in a tape printing apparatus of a so-called serial printing type, in which the thermal head 15 is moved without moving the print tape 7 and the ink ribbon 9, when printing characters or the like.

Further, the tape cassette CS directed to this embodiment is a laminate-type tape cassette where the double-sided adhesive tape 12 is laminated on the surface of the print tape 7 on which the print image is formed after forming a print image on the print tape 7. However, the disclosure is not limited to this embodiment but can be applied, for instance, to a so-called non-laminate-type tape cassette in which the double-sided adhesive tape 12 is not incorporated but merely a print image is formed on the print tape 7.

Furthermore, in the tape printing apparatus 1 directed to this embodiment, the printing energy from the thermal head 15 is controlled within a range of 20 mJ/mm$^2$ through 45 mJ/mm$^2$, and at the same time, the conveying speed of the print tape 7 and the ink ribbon 9 by the tape conveying motor 47 or the like is controlled within a range of 10 mm/sec through 80 mm/sec. However, not being limited to this embodiment, the disclosure can be applied, for instance, in a case where a plurality of tape printing apparatuses 1 are used and the different printing energy and conveying speed for each of the plurality of tape printing apparatuses 1 are fixedly set within the above-described range of the printing energy and the above-described range of conveying speed.

What is claimed is:

1. A tape cassette configured to be used in a tape printing apparatus that performs printing on a print tape using a thermal head, wherein the tape cassette incorporates a print tape spool around which the print tape is wound and a ribbon spool around which an ink ribbon is wound, and wherein a print image such as a character is to be formed on the print tape through the ink ribbon using the thermal head, wherein the ink ribbon comprises:

a base film; and a thermal printing ink layer formed on the base film and comprising a coloring layer containing wax and pigment, and an adhesive layer coated on the coloring layer, and wherein a congealing point of the thermal printing ink layer is 89 degrees Celsius or higher, and a difference between a melting point of the thermal printing ink layer and a glass transition point of the thermal printing ink layer is 23 degrees Celsius or smaller.

2. A tape printing apparatus comprising:

a thermal head;

a tape cassette incorporating a print tape spool around which a print tape is wound and a ribbon spool around which an ink ribbon is wound; and a conveying mechanism configured to pull out and convey the print tape and the ink ribbon from the print tape spool and the ribbon spool in the tape cassette, respectively, wherein a print image such as a character is formed using the thermal head, on the print tape conveyed by the conveying mechanism through the ink ribbon, wherein the ink ribbon in the tape cassette comprises:

a base film; and a thermal printing ink layer formed on the base film and comprising a coloring layer containing wax and pigment, and an adhesive layer coated in the coloring layer, and wherein a congealing point of the thermal printing ink layer is 89 degrees Celsius or higher, and a difference between a melting point of the thermal printing ink layer and a glass transition point of the thermal printing ink layer is 23 degrees Celsius or smaller.

3. A tape cassette configured to be used in a tape printing apparatus that performs printing on a print tape using a thermal head, wherein the tape cassette incorporates a print tape spool around which the print tape is wound and a ribbon spool around which an ink ribbon is wound, and wherein a print image such as a character is to be formed on the print tape through the ink ribbon using the thermal head, wherein the ink ribbon comprises:

a base film; and a thermal printing ink layer formed on the base film and comprising a coloring layer containing wax and pigment, and an adhesive layer coated on the coloring layer, and wherein a congealing point of the thermal printing layer is 89 degrees Celsius or higher, and a value obtained through dividing a melting energy of the thermal printing ink layer by a glass transition point of the thermal printing ink layer is 0.44 or smaller.

4. A tape printing apparatus comprising:

a thermal head;

a tape cassette incorporating a print tape spool around which a print tape is wound and a ribbon spool around which an ink ribbon is wound; and a conveying mechanism configured to pull out and convey the print tape and the ink ribbon from the print tape spool and the ribbon spool in the tape cassette, respectively, wherein a print image such as a character is formed using the thermal head, on the print tape conveyed by the conveying mechanism through the ink ribbon, wherein the ink ribbon in the tape cassette comprises:

a base film; and a thermal printing ink layer formed on the base film and comprising a coloring layer containing wax and pigment, and an adhesive layer coated on the coloring layer, and wherein a congealing point of the thermal printing ink layer is 89 degrees Celsius or higher, and a value obtained through dividing melting energy of the thermal printing ink layer by a glass transition point of the thermal printing ink layer is 0.44 or smaller.

5. A tape cassette configured to be used in a tape printing apparatus that performs printing on a print tape using a thermal head, wherein the tape cassette incorporates a print tape spool around which the print tape is wound and a ribbon spool around which an ink ribbon is wound, and wherein a print image such as a character is to be formed on the print tape through the ink ribbon using the thermal head, wherein the ink ribbon comprises:

a base film; and a thermal printing ink layer formed on the base film and comprising a coloring layer containing wax and pigment, and an adhesive layer coated on the coloring layer, and wherein a difference between a melting point of the thermal printing ink layer and a congealing point of the thermal printing ink layer is 7.6 degrees Celsius or smaller, and a difference between the melting point of the thermal printing ink layer and a glass transition point of the thermal printing ink layer is 23 degrees Celsius or smaller.

6. A tape printing apparatus comprising:

a thermal head;

a tape cassette incorporating a print tape spool around which a print tape is wound and a ribbon spool around which an ink ribbon is wound; and a conveying mechanism configured to pull out and convey the print tape and the ink ribbon from the print tape spool and the ribbon spool in the tape cassette, respectively, wherein a print image such as a character is formed using the thermal head, on the print tape conveyed by the conveying mechanism through the ink ribbon, wherein the ink ribbon in the tape cassette comprises:

a base film; and a thermal printing ink layer formed on the base film and comprising a coloring layer containing wax and pigment, and an adhesive layer coated on the coloring layer, and wherein a difference between a melting point of the thermal printing ink layer and a congealing point of the thermal printing ink layer is 7.6 degrees Celsius or smaller, and a difference between the melting point of the thermal printing ink layer and a glass transition point of the thermal printing ink layer is 23 degrees Celsius or smaller.

7. A tape cassette configured to be used in a tape printing apparatus that performs printing on a print tape using a thermal head, wherein the tape cassette incorporates a print tape spool around which the print tape is wound and a ribbon spool around which an ink ribbon is wound, and wherein a print image such as a character is to be formed on the print tape through the ink ribbon using the thermal head, wherein the ink ribbon comprises:

a base film; and a thermal printing ink layer formed on the base film and comprising a coloring layer containing wax and pigment, and an adhesive layer coated on the coloring layer, and wherein difference between a melting point of the thermal printing ink layer and a congealing point of the thermal printing ink layer is 7.6 degrees Celsius or smaller, and a value obtained through dividing melting energy of the thermal printing ink layer by a glass transition point of the thermal printing ink layer is 0.44 or smaller.

8. A tape printing apparatus comprising:

a thermal head;

a tape cassette incorporating a print tape spool around which a print tape is wound and a ribbon spool around which an ink ribbon is wound; and a conveying mechanism configured to pull out and convey the print tape and the ink ribbon from the print tape spool and the ribbon spool in the tape cassette, respectively, wherein a print image such as a character is formed using the thermal head, on the print tape conveyed by the conveying mechanism through the ink ribbon, wherein the ink ribbon in the tape cassette comprises:

a base film; and a thermal printing ink layer formed on the base film and comprising a coloring layer containing wax and pigment, and an adhesive layer coated on the coloring layer, and wherein difference between a melting point of the thermal printing ink layer and a congealing point of the thermal printing ink layer is 7.6 degrees Celsius or smaller, and a value obtained through dividing melting energy of the thermal printing ink layer by a glass transition point of the thermal printing ink layer is 0.44 or smaller.

* * * * *